US009931876B2

(12) United States Patent
Satou et al.

(10) Patent No.: US 9,931,876 B2
(45) Date of Patent: Apr. 3, 2018

(54) METHOD OF MANUFACTURING A DECORATIVE BUILDING BOARD

(71) Applicant: NISSHIN STEEL CO., LTD., Tokyo (JP)

(72) Inventors: Masaki Satou, Chiba (JP); Seiju Suzuki, Chiba (JP); Hidenori Yoshida, Chiba (JP); Shuichi Sugita, Chiba (JP); Yuuichi Okada, Chiba (JP)

(73) Assignee: NISSHIN STEEL CO., LTD., Tokyo (JP)

( * ) Notice: Subject to any disclaimer, the term of this patent is extended or adjusted under 35 U.S.C. 154(b) by 0 days.

(21) Appl. No.: 15/100,208

(22) PCT Filed: Dec. 26, 2013

(86) PCT No.: PCT/JP2013/084855
§ 371 (c)(1),
(2) Date: May 27, 2016

(87) PCT Pub. No.: WO2015/079596
PCT Pub. Date: Jun. 4, 2015

(65) Prior Publication Data

US 2017/0028758 A1 Feb. 2, 2017

(30) Foreign Application Priority Data

Nov. 29, 2013 (JP) ..... 2013-247592

(51) Int. Cl.
*B41J 2/21* (2006.01)
*B41M 5/00* (2006.01)
(Continued)

(52) U.S. Cl.
CPC ..... *B41M 5/0017* (2013.01); *B41M 5/0047* (2013.01); *B41M 5/5209* (2013.01);
(Continued)

(58) Field of Classification Search
CPC ..... B41J 2/2107; B41M 5/0017
See application file for complete search history.

(56) References Cited

U.S. PATENT DOCUMENTS

2002/0047872 A1* 4/2002 Ishikawa ..... B41J 2/04541 347/10
2005/0012778 A1* 1/2005 Nishino ..... B41J 11/002 347/29

(Continued)

FOREIGN PATENT DOCUMENTS

JP 2008068453 A 3/2008
JP 2008273055 A 11/2008

(Continued)

OTHER PUBLICATIONS

International Search Report, PCT/JP2013/084855 dated Jan. 28, 2014, 2 pages.

(Continued)

*Primary Examiner* — Jason Uhlenhake
(74) *Attorney, Agent, or Firm* — Rothwell, Figg, Ernst & Manbeck, P.C.

(57) ABSTRACT

The present invention relates to a method of manufacturing a decorative building board, including: ejecting active ray-curable ink from an ink jet recording head onto a building board that includes a base material selected from a metallic base material and a ceramic base material and an ink receiving layer arranged on the base material, the ink receiving layer being obtained by curing a resin composition and having an arithmetic average roughness (Ra) specified under JIS B 0601:2001 of from 0.4 μm to 3 μm, to thereby perform printing on the ink receiving layer; and irradiating the active ray-curable ink with an active ray from 2.2 seconds to 30 seconds after the active ray-curable ink lands on the ink receiving layer.

9 Claims, 3 Drawing Sheets

(51) Int. Cl.

| | |
|---|---|
| ***B41M 5/52*** | (2006.01) |
| ***B41M 7/00*** | (2006.01) |
| *E04F 13/12* | (2006.01) |
| *B41M 5/50* | (2006.01) |

(52) U.S. Cl.
CPC ..... *B41M 7/0081* (2013.01); *B41M 5/502* (2013.01); *B41M 5/5254* (2013.01); *B41M 5/5272* (2013.01); *E04F 13/123* (2013.01)

(56) References Cited

U.S. PATENT DOCUMENTS

| | | | | |
|---|---|---|---|---|
| 2010/0149265 | A1* | 6/2010 | Hino | B41J 2/1603 347/47 |
| 2013/0340219 | A1* | 12/2013 | Wang | B41J 2/164 29/25.35 |

FOREIGN PATENT DOCUMENTS

| | | | | |
|---|---|---|---|---|
| JP | 2010194462 | a | * | 2/2009 |
| JP | 2010112073 | A | | 5/2010 |
| JP | 2010194462 | A | | 9/2010 |
| JP | 2012087504 | A | | 5/2012 |

OTHER PUBLICATIONS

European Search Report for PCT/JP2013/084855, dated Sep. 8, 2017, 13 pages.

* cited by examiner

METHOD OF MANUFACTURING A DECORATIVE BUILDING BOARD

CROSS-REFERENCE TO RELATED APPLICATIONS

The present application is a national stage filing under 35 U.S.C. §371 of PCT/JP2013/0084855, filed on 26 Dec. 2013, which in turn claims the benefit of priority to Japanese Application No. 2013-247592, filed 29 Nov. 2013. Each application is incorporated herein by reference in its entirety.

TECHNICAL FIELD

The present invention relates to a method of manufacturing a decorative building board by forming an image having a high designability on a metallic base material or a ceramic base material used in the technical field of building materials through use of an ink jet recording apparatus.

BACKGROUND ART

In recent years, ink jet recording systems have been used in various fields because such systems are capable of easily forming a wide variety of patterns on a base material at low cost.

In particular, an active ray-curable ink jet system has relatively low odor as compared to solvent type ink jet systems and is capable of forming an image on a recording material having no fast-drying properties or ink absorbability, and hence active ray-curable ink jet systems are drawing attention (for example, Patent Literature 1).

Further, ink jet recording systems have been used in various fields as described above, and not only for paper materials but also for building materials, such as siding materials (for example, Patent Literature 2).

In Patent Literature 2, there is a disclosure that, with the purpose of providing an ink jet recording method capable of easily ensuring suitable quality in patterning with respect to building materials, dots are formed to perform patterning through use of ink drops in which the initial speed of each ink drop discharged from ink jet recording head is adjusted and the volume of one drop that lands on a surface of a recording material is set to 45 picoliters.

Further, in Patent Literature 1, there is a disclosure of a method of forming an image through use of active ray-curable ink capable of stably reproducing an image with high definition on various recording materials, and specifically, there is a disclosure of a method of forming an image involving performing printing on a recording material, in which the active ray-curable ink is irradiated with a particular light source between 0.001 second and 1.0 second after the active ray-curable ink lands on the recording material.

On the other hand, aqueous ink has also been conventionally used as ink to be used in the ink jet recording system. The ink receiving layer of the ink jet recording material in this case has a porous structure. When the ink lands on the ink receiving layer of the recording material, the ink rapidly spreads with wetting (within 0.5 second) due to capillary action, and the ink dot diameter stabilizes within 0.5 second.

CITATION LIST

Patent Literature

[Patent Literature 1] JP 4539104 B2
[Patent Literature 2] JP 2012-87504 A

SUMMARY OF INVENTION

Technical Problem To Be Solved

In general, ink jet printing is performed through use of aqueous or solvent-based ink in most cases. However, active ray-curable inks contain few volatile components such as solvents or water, and hence active ray-curable inks have an advantage in that uneven color development caused by the influence of the volatilization rate and permeation rate of the solvent, decrease in printing quality caused by the effect of the wet spread of ink, and the like are not liable to occur, and high quality printing can be stably performed.

However, in the case where the active ray-curable ink is cured by irradiation of an active ray immediately after the active ray-curable ink lands on a recording material, for example, in the case where the ink is cured within 1 second after the ink lands on the surface of the recording material as in Patent Literature 1, the ink is still in the middle of wet spread, and hence there is a problem in that coloring does not become stable. In addition, ink jet heads of an ink jet recording apparatus are arranged in parallel for each color, and the time period from landing to irradiation of an active ray varies slightly depending on the color. Therefore, the manner of wet spread varies depending on the color when the time period to irradiation of an active ray is short, to thereby cause a problem in the designability of an image. That the active ray-curable ink contains few volatile components such as solvents or water is also one of the reasons that a certain time period is required for an ink drop to stably spread with wetting.

Further, when the surface of the recording material is flat, ink does not sufficiently spread with wetting even when the time period to irradiation of an active ray is regulated. Therefore, it is necessary to form appropriate irregularities.

In addition, in, for example, building materials intended to be used outdoors, in the case where an image is formed by a related-art ink jet recording system using aqueous ink, the surface of the recording material must be permeable, and hence there is a problem in durability of a formed image due to the influence of rain and the like in some cases. Even in the case where the image is coated with waterproof paint so as to ensure durability, when the coating is damaged, water will permeate the image from the damaged portion. Thus, it is fundamentally difficult to solve the problem.

Solution to Problem

In view of the foregoing, the inventors of the present invention have made extensive investigations, and as a result, have found that an image having a high designability is formed by arranging particular irregularities on a building board obtained by forming an ink receiving layer with paint on a metallic base material or a ceramic base material, and irradiating active ray-curable ink with an active ray within a particular time period after the active ray-curable ink lands on a surface of the ink receiving layer.

Specifically, according to one embodiment of the present invention, there is provided a method of manufacturing a decorative building board, including: ejecting active ray-curable ink from an ink jet recording head onto a building board that includes a base material selected from a metallic base material and a ceramic base material and an ink receiving layer arranged on the base material, the ink receiving layer being obtained by curing a resin composition and having an arithmetic average roughness (Ra) specified under JIS B 0601:2001 of from 0.4 μm to 3 μm, to thereby perform printing on the ink receiving layer; and irradiating the active ray-curable ink with an active ray within 2.2 seconds or more and 30 seconds or less after the active ray-curable ink lands on the ink receiving layer.

Advantageous Effects of Invention

According to the method of manufacturing a decorative building board according to the one embodiment of the present invention, a pattern having a high designability can be provided by the ink jet recording system to, for example, a building board that requires weather resistance and water resistance.

DESCRIPTION OF EMBODIMENTS

Figure 1:
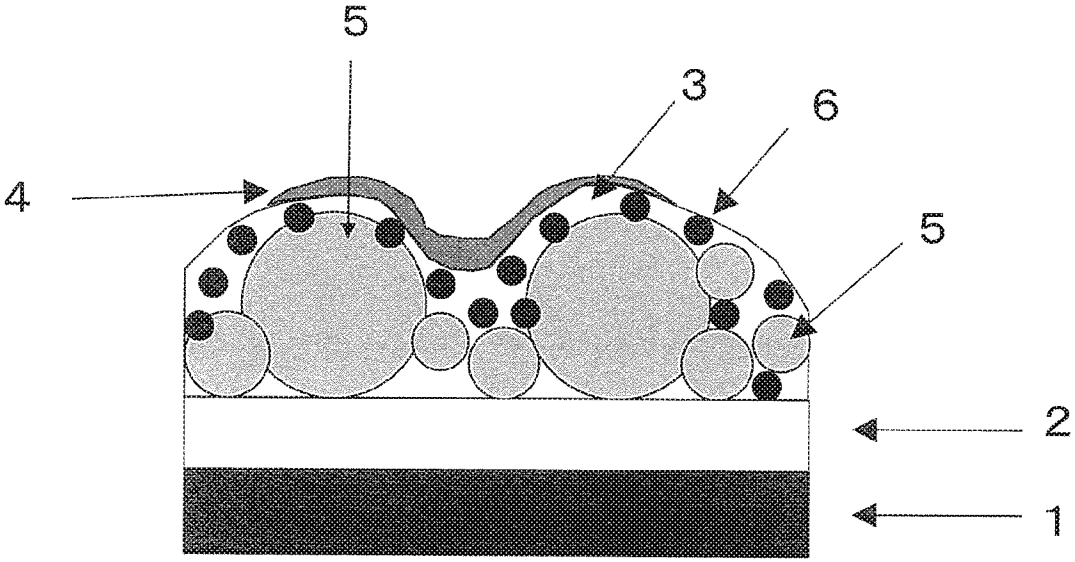
FIG. 1 is a schematic sectional view of a decorative building board having an arithmetic average roughness Ra adjusted within a range of from 0.4 μm to 3 μm by adding solid particles to paint.

As described above, a method of manufacturing a decorative building board of the present invention includes ejecting active ray-curable ink from an ink jet recording head onto a building board in which an ink receiving layer obtained by curing a resin composition is formed on a base material selected from a metallic base material and a ceramic base material, to thereby perform printing on the ink receiving layer.

It is preferred that the method of manufacturing a decorative building board of the present invention be used for forming an image on a metallic base material to be used for building boards, such as metallic siding, decorative interior materials, decorative exterior materials, decorative floor materials, and elevator door materials. Examples of the metallic base materials include: plated steel sheet, such as molten Zn-55% Al alloy plated steel sheet; steel sheet, such as common steel sheet or stainless steel sheet; aluminum sheet; and copper sheet. These metal sheets may be subjected to irregularity processing such as tile-like shapes, brick-like shapes, or woodgrain shapes through embossing, drawing, or the like. Further, for the purpose of improving thermal insulation and sound insulation, the back surface of the metallic base material may be covered with, for example, aluminum laminated craft paper containing an inorganic material, such as resin foam or plaster board, as a core material.

Examples of ceramic base materials include unglazed ceramic sheet, glazed and sintered ceramic sheet, cement sheet, and sheet molded through use of a cement raw material, a fiber raw material, or the like. Specifically, there are "wood fiber reinforced cement sheet systems" containing wood fibers and wood chips as a reinforcing material, and "fiber reinforced cement sheet systems" and "fiber reinforced cement/calcium silicate sheet systems" including pulp and synthetic fibers as a reinforcing material.

Further, those ceramic base materials may be subjected to irregularity processing, to thereby form a surface of the base material into tile-like shapes, brick-like shapes, woodgrain shapes, or the like.

The ink receiving layer to be used in the present invention is a coating film formed by curing a resin composition. Herein, as paint capable of forming a coating film on the base material, generally-used resins of polymer compounds can be used. Examples thereof include polymer compounds, such as polyester resins, acrylic resins, polyvinylidene fluoride resins, polyurethane resins, epoxy resins, polyvinyl alcohol resins, and phenol resins. Of these, polyester resins or acrylic resins are preferred as the polymer compound to be used in the present invention from the viewpoints of their high weather resistance and excellent adhesion of the ink to them.

It should be noted that it is preferred to avoid the use of paint that forms a porous ink receiving layer used as a related-art ink receiving layer for aqueous ink. Such porous ink receiving layer may have problems in water resistance and weather resistance and may not be suitable for use in building materials and the like.

In the above-mentioned resins of polymer compounds, a curing agent may be used so as to adjust the characteristics and physical properties of the resin. When a polyester resin is used, a melamine-based curing agent (melamine resin curing agent) is desirably used. Examples thereof include methylated melamine (methylolmelamine methyl ether), n-butylated melamine (methylolmelamine butyl ether), and mixed etherified melamine of methyl and n-butyl. An ink receiving layer having a crosslink density increased through use of a curing agent as described above is particularly preferred because the ink receiving layer has excellent water resistance and weather resistance due to non-permeability with respect to the active ray-curable ink. Through observation of a cross section of the ink receiving layer and an ink layer with a microscope at a magnification of from 100 times to 200 times, it can be confirmed that the ink receiving layer is non-permeable with respect to the active ray-curable ink. In cases where the ink receiving layer is non-permeable, an interface between the ink receiving layer and the ink layer can be clearly identified. However, in cases where the ink receiving layer is permeable, the interface becomes unclear and difficult to identify.

In the case where a polyester resin is used as the above-mentioned polymer compound, the number average molecular weight thereof in the case of being measured by GPC is preferably from 2,000 to 8,000. When the molecular weight is less than 2,000, processability is decreased, and cracks may be easily formed in the coating film. Further, when the molecular weight is more than 8,000, weather resistance may be decreased due to a decrease in crosslink density. From the viewpoint of the balance between processability and weather resistance, the number average molecular weight is preferably from 3,000 to 6,000 in particular.

Further, in the case where an acrylic resin emulsion is used as the above-mentioned polymer compound, the number average molecular weight thereof in the case of being measured by GPC is preferably from 200,000 to 2,000,000.

The ink receiving layer of the present invention has an arithmetic average roughness Ra specified under JIS B 0601:2001 of from 0.4 μm to 3 μm. When the arithmetic average roughness Ra is less than 0.4 μm, the wet spread of ink-jet ink is insufficient, and hence dot diameter is stable even when the ink-jet ink is irradiated with an active ray, such as a UV ray, within less than 2.2 seconds after landing of the ink-jet ink. However, gaps are generated between ink dots, and thus there is a problem in that color development property with respect to ink application amount becomes insufficient. Further, it is not preferred that the arithmetic average roughness Ra be more than 3 μm because the ink-jet ink is buried in irregular grooves of the coating film on a surface of the ink receiving layer, and the color becomes pale. The arithmetic average roughness Ra for sufficiently ensuring the wet spread property and the color development property with respect to an ink application amount is preferably from 0.5 μm to 2 μm in particular.

There is no particular limitation on the method of adjusting the Ra of the ink receiving layer of the present invention within the above-mentioned range, but for example, there is given a method involving adding inorganic or organic solid particles having an average particle diameter of from 4 μm to 80 μm, preferably from 10 μm to 60 μm to the paint serving as the resin composition.

Examples of the inorganic particles include silica, barium sulfate, talc, calcium carbonate, mica, glass beads, and glass flakes. In addition, examples of the organic particles include acrylic resin beads and polyacrylonitrile resin beads. The resin beads may be resin beads produced by using a known method, or commercially available products thereof may be used. Examples of commercially available acrylic resin beads include "TAFTIC AR650S (average particle diameter: 18 μm)," "TAFTIC AR650M (average particle diameter: 30 μm)," "TAFTIC AR650MX (average particle diameter: 40 μm)," "TAFTIC AR650MZ (average particle diameter: 60 μm)," "TAFTIC AR650ML (average particle diameter: 80 μm)," "TAFTIC AR650L (average particle diameter: 100 μm)," and "TAFTIC AR650LL (average particle diameter: 150 μm)" all manufactured by Toyobo Co., Ltd. In addition, examples of the commercially available polyacrylonitrile beads include "TAFTIC A-20 (average particle diameter: 24 μm)," "TAFTIC YK-30 (average particle diameter: 33 μm)," "TAFTIC YK-50 (average particle diameter: 50 μm)," and "TAFTIC YK-80 (average particle diameter: 80 μm)" all manufactured by Toyobo Co., Ltd.

The amount of the organic or inorganic particles in this case is generally from 2 mass % to 40 mass %, preferably from 10 mass % to 30 mass % with respect to the mass of the coating film.

Average particle diameters of the solid particles and a coloring pigment are determined by a Coulter counter method.

Further, a coloring pigment can be added to the paint for forming the ink receiving layer to such a degree as not to influence the irregularities. The average particle diameter of the coloring pigment in this case is generally from 0.2 μm to 2.0 μm. As the coloring pigment, there may be mentioned carbon black, titanium oxide, iron oxide, yellow iron oxide, phthalocyanine blue, and cobalt blue.

Further, in the case where the coloring pigment is added, the coloring pigment is generally added to the paint so as to be from 40 mass % to 60 mass % with respect to the mass of the coating film.

It should be noted that the arithmetic average roughness (Ra) is obtained as follows. When a roughness curve is represented by y=f(x), a portion of a measurement length L is taken out from the roughness curve in the direction of an average line of the roughness curve. The average line of the portion that is taken out is represented by an X-axis, and the direction of longitudinal magnification is represented by a Y-axis. A value determined by Expression (I) below is expressed in terms of micrometers (μm).

$$Ra = \frac{1}{L}\int_0^L |f(x)|dx \quad \text{(I)}$$

f(x) can be measured by various methods such as a stylus type surface roughness meter, an atomic force microscope (AFM), and a scanning tunnel microscope (STM). A numerical value of the arithmetic average roughness as described herein is a numerical value determined by a stylus type surface roughness meter also as shown in the following Examples.

It should be noted that JIS B 0601:2001 used in the present invention is based on ISO4287:1997.

An ink receiving layer coating film according to an embodiment of the present invention is described with reference to FIG. 1.

FIG. 1 is a schematic sectional view of an ink receiving layer having an arithmetic average roughness Ra adjusted within a range of from 0.4 μm to 3 μm by adding solid particles to paint.

A decorative building board of the present invention includes base material 1, optional primer layer 2, ink receiving layer 3, ink layer 4, solid particles 5, and optional coloring pigment 6.

As base material 1, as described above, there may be mentioned a metallic base material, such as plated steel sheet, stainless steel, cold-rolled steel sheet, or aluminum sheet, or a ceramic base material, such as a ceramic siding material.

When a metal sheet is used as base material 1, the surface of the metal sheet may be subjected to known chemical conversion treatment, such as chromate treatment.

Primer layer 2 may be optionally formed on base material 1. As a resin for forming primer layer, the same polymer compound as the resin for forming the coating film may be used, and there may be mentioned polymer compounds such as polyester resins, acrylic resins, polyurethane resins, epoxy resins, polyvinyl alcohol resins, and phenol resins.

Further, the thickness of primer layer 2 is generally from 2 μm to 10 μm, preferably from 3 μm to 7 μm. primer layer 2 is formed for the purposes of improving adhesion between base material 1 and ink receiving layer 3 and improving rust resistance of base material 1 by adding a rust resisting pigment. Thus, in the case where the adhesion between base material 1 and ink receiving layer 3 is sufficient, and base material 1 is not a metallic base material, primer layer 2 need not be formed.

Ink receiving layer 3 forms the surface of the ink receiving layer together with solid particles 5 and coloring pigment 6, to thereby receive ink. A resin for forming ink receiving layer 3 is as described above.

There is no particular limitation on the thickness of the ink receiving layer, but the thickness generally falls within a range of from 3 μm to 30 μm. In the case where the coating film is excessively thin, there is a risk in that the durability and coverage property of the coating film may be insufficient. Meanwhile, in the case where the coating film is excessively thick, production cost is increased, and foams are liable to be generated during baking.

As the active ray-curable ink of the present invention, ink that is generally used in the art is used. As the generally-used ink, there are radically polymerizable inks and cationically polymerizable inks, and any of them can be used.

The active ray-curable ink generally contains monomers or oligomers, photopolymerization initiators, coloring materials, dispersants, surfactants, and any other additives. In the present invention, materials generally used in the art are used. Cationically polymerizable inks are particularly preferred because their volume contraction ratio is smaller than that of radically polymerizable inks, and high adhesion is obtained also with respect to a non-permeable ink receiving layer having increased crosslink density.

The active ray-curable ink of the present invention is cured by irradiation of an active ray within 2.2 seconds to 30 seconds after the ink lands on the surface of the ink receiving layer. When the active ray-curable ink is cured for less than 2.2 seconds by irradiation of an active ray, the wet spread speed of an ink dot is still in a high stage, and hence dot diameter is unstable, making image quality unstable. Further, in the case where the radically polymerizable ink is irradiated with an active ray after more than 30 seconds, it becomes difficult for the radically polymerizable ink to form an ink coating film having sufficient hardness owing to oxygen polymerization inhibition. Further, in the case where the cationically polymerizable ink is irradiated with an active ray after more than 30 seconds, water in air will permeate the ink coating film to inhibit polymerization, with the result that it similarly becomes difficult to form an ink coating film having sufficient hardness. The curing degree of an active ray by cation polymerization decreases as the content of water in ink increases and is significantly influenced by humidity. Therefore, it is preferred that the ink be irradiated with an active ray within 15 seconds after landing of the ink. Further, in order to remove water adsorbing to the ink receiving layer, the ink receiving layer may be heated to from 40° C. to 100° C. before ink jet printing.

The method of manufacturing a decorative building board of the present invention is hereinafter described.

Figure 2:
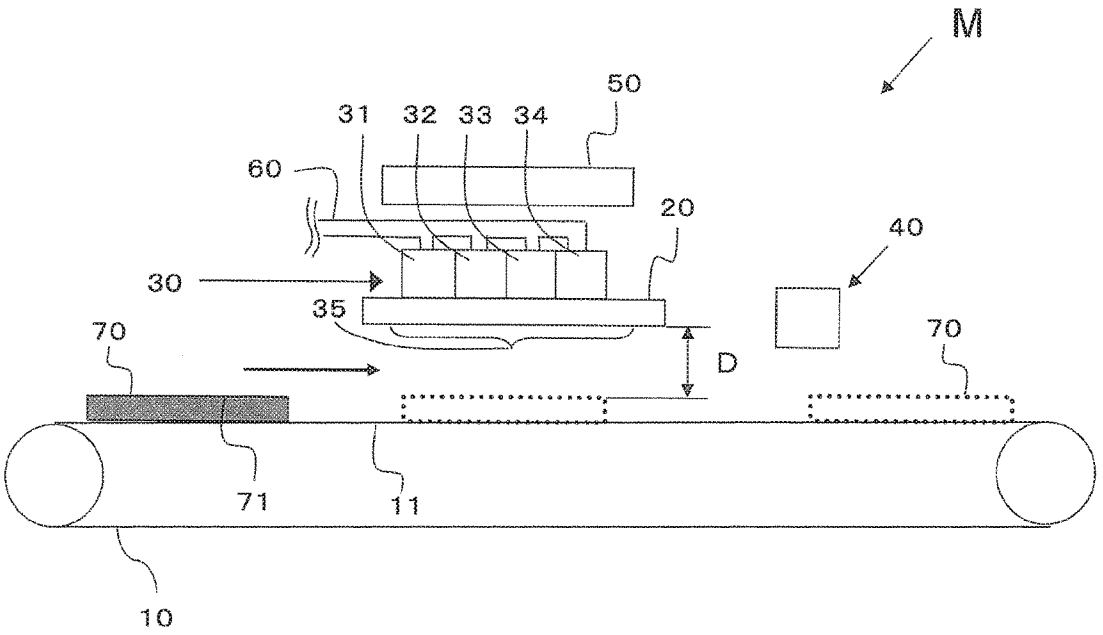
FIG. 2 is an illustration of an example of a line-type ink jet recording apparatus to be used for carrying out the present invention.

In the method of manufacturing a decorative building board of the present invention, a line-type ink jet recording apparatus as illustrated in FIG. 2 is used. Such line-type ink jet recording apparatus is described in detail in, for example, Japanese Patent Laid-Open No. 2012-87504.

Line-type ink jet recording apparatus M illustrated in FIG. 2 includes conveyance part 10, carriage 20, recording part 30, active ray irradiation part 40, and control part 50.

Ink receiving surface 71 of building board 70 is the surface on the opposite side to the surface that is brought into contact with conveyance surface 11 of conveyance part 10. Ink receiving surface 71 is colored with active ray-curable ink ejected from the recording part, and thus a desired image can be formed on the ink receiving layer.

Conveyance part 10 is formed of a conveyer or the like. Conveyance part 10 is configured to convey building board 70 mounted on conveyance surface 11. The conveyance direction is as indicated by the arrow in FIG. 2, and in accordance with FIG. 2, building board 70 is conveyed from a left-side end of conveyance part 10 to a right-side end thereof so as to pass by carriage 20 and active ray irradiation part 40. The speed at which conveyance part 10 conveys building board 70 is adjusted to such a speed that building board 70 passes under active ray irradiation part 40 within a range of 2.2 seconds to 30 seconds after the ink lands on ink receiving surface 71.

Carriage 20 includes recording part 30. Recording part 30 is mounted and fixed onto carriage 20. Recording part 30 includes, for example, recording head units 31, 32, 33, and 34. Recording head unit 31 includes a plurality of recording heads for discharging black ink. Recording head unit 32 includes a plurality of recording heads for discharging cyan ink. Recording head unit 33 includes a plurality of recording heads for discharging magenta ink. Recording head unit 34 includes a plurality of recording heads for discharging yellow ink. That is, recording part 30 includes a plurality of recording heads. The plurality of recording heads forming recording head unit 31 are aligned in a plurality of rows in a direction orthogonal to the conveyance direction and arranged so that the recording heads in adjacent rows are arranged in a zigzag manner. The plurality of recording heads of each of recording head units 32, 33, and 34 are arranged in the same manner as that of recording head unit 31. It should be noted that a plurality of nozzles are formed in the recording heads forming recording head units 31, 32, 33, and 34 of the respective colors. Ink of each color is specifically discharged from the nozzles. It should be noted that, through such use of four ink colors, a full-color image can be formed.

Recording part 30 being fixed onto carriage 20 is installed at a position separated from conveyance surface 11 in a vertical direction and at a position where a variation in height of ink receiving surface 71 based on conveyance surface 11 is allowed where each of building board 70 conveyed successively by conveyance part 10 passes by recording part 30. Specifically, recording part 30 is installed at a position where a distance D between a surface of recording part 30 opposed to conveyance surface 11, more specifically, ink discharge surface 35 of the plurality of recording heads forming respective recording head units 31, 32, 33, and 34 and ink receiving surface 71 of building board 70 is 2 mm or more, specifically, from about 5 mm to about 10 mm. In a state in which recording part 30 is mounted on carriage 20, the surface of carriage 20 opposed to conveyance surface 11 and ink discharge surface 35 are set to the same height so as to be included in the same plane.

It should be noted that ink drops discharged from the recording heads forming recording head units 31, 32, 33, and 34 of the respective colors fly in a space having distance D between ink discharge surface 35 and ink receiving surface 71 in the vertical direction toward ink receiving surface 71. The initial speed of each ink drop is generally set to from 3 m/sec to 9 m/sec, preferably from 4 m/sec to 7 m/sec. The initial speed of the ink drop refers to the speed of the ink drop at time of being discharged from the recording head. For example, the initial speed of the ink drop is calculated based on a distance of 1 mm in the vertical direction from ink discharge surface 35 and the time required for the ink drop discharged from the recording head to move the distance of 1 mm (predetermined distance/time).

When the initial speed of the ink drop is less than 3 m/sec, the speed of the liquid drop is excessively low, and hence the landing accuracy of the ink drop may be significantly decreased. Further, when the initial speed of the ink drop is more than 9 m/sec, the landing accuracy is satisfactory, but a large amount of satellites may be generated to decrease image quality. Here, the term satellite refers to small liquid drops generated together with an ink main liquid drop.

There is no particular limitation on the volume of one ink drop discharged from the nozzle of ink discharge surface 35 to ink receiving surface 71, but the volume is generally set to less than 60 pl (picoliters), preferably 10 pl or more and less than 45 pl. When the volume is 60 pl or more, dot diameter becomes excessively large to cause a conspicuous granular feeling, and hence there may be a problem in design property of an image to be formed. Further, when the volume is less than 10 pl, the distance between the ink discharge surface and the ink receiving surface needs to be set to less than 2 mm in order to ensure landing accuracy of the ink drop. Therefore, printing may be technically difficult from the viewpoint of the flatness of base material 1.

Active ray irradiation part 40 is installed at a predetermined position on a downstream side of recording part 30 in the conveyance direction. As the "active ray" in the present invention, there may be mentioned electron beams, UV rays, α-rays, α-rays, and X-rays. In the present invention, in consideration of safety and handling properties, electron beams and UV rays are preferably used, and UV rays are most preferably used.

The active ray irradiation part 40 includes a lamp for radiating an active ray, which is installed so as to face conveyance surface 11 of conveyance part 10, and is configured to radiate an active ray toward conveyance surface 11.

The irradiation of an active ray is started, for example, under the conditions that building board 70 has been detected by a detection sensor (not shown) installed at a predetermined position on a downstream side of recording part 30 in the conveyance direction and on an upstream side of active ray irradiation part 40 in the conveyance direction. In this case, the position of active ray irradiation part 40 is such a position that ink receiving surface 71 passes under active ray irradiation part 40 within 2.2 seconds to 30 seconds after the ink lands on ink receiving surface 71 and the position is determined also in consideration of the control of the moving speed of a belt of conveyance part 10. The irradiation of an active ray is stopped when it has been detected that building board 70 has passed by irradiation part 40 by a detection sensor (not shown) installed at a predetermined position on a downstream side of active ray irradiation part 40 in the conveyance direction. The irradiation of an active ray may be stopped when a predetermined time elapses after start of the irradiation of the active ray.

Further, there are cases where the active ray irradiation part 40 cannot be installed in the vicinity of recording part 30 from the viewpoint of the structure of the line-type ink jet recording apparatus M. For example, in the case where an existing line-type ink jet recording apparatus does not include the active ray irradiation part, it is necessary to separately install the active ray irradiation part. Further, in general, the building board to be used in the present invention is a board measuring several meters to ten odd meters per side, and hence it is not preferred that the moving speed of a conveyance belt be excessively increased from the viewpoints of safety and the like. Considering this and other reasons, from the viewpoint of manufacturing, it is desired that ink discharged from the recording head be irradiated with an active ray after 3 seconds or more, preferably 4 seconds or more, more preferably 5 seconds or more from the ink landing on the ink receiving surface.

However, the following should be noted. In the case where the moving speed of the conveyance belt is excessively low, the production efficiency is degraded. Therefore, it is desired that, even when the active ray irradiation part is installed away from the recording part, the moving speed be adjusted so that the ink discharged from the recording head be irradiated with an active ray within 25 seconds, preferably 20 seconds, more preferably 15 seconds after the ink lands on the ink receiving surface.

Control part 50 is configured to control various kinds of processing including patterning by recording of an image formed byline-type ink jet recording apparatus M. Control part 50 includes a circuit board having mounted thereon electronic components, electric wiring, and the like. At least a partial structure included in control part 50 is installed in an upper portion of recording part 30 as illustrated in FIG. 2.

In addition, line-type ink jet recording apparatus M includes tanks (not shown) for storing ink of each color (black, cyan, magenta, yellow), and the ink is supplied to the plurality of recording heads of each recording head unit (31 to 34) through ink supply pipe 60. For example, black ink is supplied from the tank for storing the black ink to the plurality of recording heads of recording head unit 31 through ink supply pipe 60. The same also applies to the other colors.

Line-type ink jet recording apparatus M includes a predetermined interface (not shown), such as a network interface. Line-type inkjet recording apparatus M is connected to an external device, such as a personal computer, through the interface so as to communicate with the external device. The external device is configured to input a record instruction of an image onto ink receiving surface 71, data on the image to be recorded, and the like into line-type ink jet recording apparatus M. In line-type ink jet recording apparatus M, after receiving the record instruction, predetermined processing is performed, and the above-mentioned ink is discharged from ink discharge surface 35 to form a desired image on ink receiving surface 71, to thereby perform the method of manufacturing a decorative building board of the present invention.

In the method of manufacturing a decorative building board of the present invention, first, the conveyance of building board 70 placed on conveyance surface 11 of conveyance part 10 is started. Next, in recording part 30, black dots of black ink, cyan dots of cyan ink, magenta dots of magenta ink, and yellow dots of yellow ink are recorded on ink receiving surface 71. The ink of each color is discharged from the recording heads of recording head units 31, 32, 33, or 34 of the corresponding color. The volume of ink drops in this case is set to be less than 60 pl (picoliters), preferably 10 pl or more and less than 45 pl as described above.

After that, building board 70 is further conveyed by conveyance part 10, and after the elapse of a predetermined time, building board 70 passes under active ray irradiation part 40, and ink receiving surface 71 is irradiated with an active ray. As a result, the ink that has landed on ink receiving surface 71 is cured by irradiation of an active ray because the ink is an active ray-curable ink.

Thus, a desired image is formed on ink receiving surface 71 of building board 70, to manufacture a decorative building board.

EXAMPLES

1. Manufacturing of Building Board

Examples of Present Invention 1-1 to 1-5, and Comparative Examples 1-1 and 1-2

A molten Zn-55% Al alloy plated steel sheet having a thickness of 0.27 mm and a plating adhesion amount of 90 $g/m^2$ per surface of an A4 size was used as a base material. The plated steel sheet was subjected to alkali degreasing. Then, coating-type chromate (NRC300NS: manufactured by Nippon Paint Co., Ltd., adhesion amount of 50 $mg/m^2$ in terms of Cr) and commercially available epoxy resin-based primer paint serving as a primer layer (manufactured by Nippon Fine Coatings, Inc., 700P) were applied onto the plated steel sheet with a roll coater to have a dry thickness of 5 μm and baked to reach a highest achieving sheet temperature of 215° C.

The contents of the paint serving as a resin composition for forming an ink receiving layer are as follows. As a resin, a polymer polyester resin (manufactured by DIC Corporation) having a number average molecular weight of 5,000, a glass transition temperature of 30° C., and a hydroxyl value of 28 mgKOH/g was used. As a melamine resin serving as a crosslinking agent, a methylated melamine resin containing 90 mol % of methoxy groups (manufactured by Mitsui Cytec Ltd., Cymel 303) was used. The blending ratio between the polyester resin and the melamine resin was 70/30, and as a coloring pigment, titanium oxide having an average particle diameter of 0.28 μm (manufactured by Tayca Corporation, JR-603), mica having an average particle diameter of 10 μm (manufactured by Yamaguchi Mica Co., Ltd., SJ-010), hydrophobic silica having an average particle diameter of 5.5 μm (manufactured by Fuji Silysia Chemical Ltd., Silysia 456), and hydrophobic silica having an average particle diameter of 12 μm (manufactured by Fuji Silysia Chemical Ltd., Silysia 476) were added. The specific addition amounts are shown in Table 1. As a catalyst, dodecylbenzenesulfonic acid was added in an amount of 1 mass % with respect to a resin solid content. Further, as an amine, dimethylaminoethanol was added in an amount of 1.25 times as an amine equivalent with respect to an acid equivalent of dodecylbenzenesulfonic acid. The paint was applied with a roll coater to have a dry thickness of 18 μm and baked to reach a highest achieving sheet temperature of 225° C.

It should be noted that each average particle diameter of the above-mentioned mica, hydrophobic silica, and titanium oxide was determined by a Coulter counter method.

Specifically, the average particle diameter was measured as follows. As a measurement device, a Coulter counter (manufactured by Coulter Electronics Inc. (US)) TA-II was used. About 0.5 g of a sample was put into a 200 ml beaker, and about 150 ml of pure water was added thereto. The mixture was dispersed with an ultrasonic wave (Ultrasonic Cleaner B-220) for from 60 seconds to 90 seconds. Several drops of the dispersion liquid were added by a dropper to 150 ml of an accompanying electrolytic solution (ISOTON II: NaCl aqueous solution having a high purity of 0.7%), and particle size distribution was determined through use of the above-mentioned device.

It should be noted that an aperture tube of 30 μm was used for the above-mentioned JR-603 (titanium oxide) and Silysia 456 (hydrophobic silica). Further, an aperture tube of 50 μm was used for SJ-010 (mica) and Silysia 476. The average particle diameter was determined by reading 50% diameter of an accumulated particle size distribution diagram.

Examples of Present Invention 2-1 to 2-5, and Comparative Examples 2-1 and 2-2

The same processing was performed until the primer layer was formed through use of the same plated steel sheet as above.

As paint for an ink receiving layer, acrylic emulsion base paint (manufactured by Kansai Paint Co., Ltd., IM Coat 4100) was used. A coloring pigment and solid particles were blended with the paint in the amounts shown in Table 1. The paint composition was applied onto the primer layer with an air spray to have a dry thickness of 20 μm and baked at 130° C. for 5 minutes, to thereby prepare a building board having a coating film for receiving ink.

Examples of Present Invention 3-1 to 3-5, and Comparative Examples 3-1 and 3-2

The same acrylic emulsion base paint as above was applied onto the surface of a fiber reinforced cement plate-based ceramic siding having a composition containing wood fibers and wood chips as a reinforcing material, which was produced based on JIS A 5422 as an exterior material, and baked under the same conditions, to thereby manufacture a building board having an ink receiving layer.

2. Measurement of Arithmetic Average Roughness (Ra) of Coating Film Surface of Building Board The arithmetic average roughness (Ra) of the surface of an ink receiving layer of a building board was measured under the following conditions through use of a stylus type surface roughness meter Dektak 150 manufactured by Ulvac-Phi, Inc. (vertical resolution: 0.1 nm/6.5 μm, 1 nm/65.5 μm, 8 nm/524 μm) by a stylus type surface roughness measurement method based on JIS B 0601:2001.

| | |
|---|---|
| (i) Stylus pressure: | 3 mg |
| (ii) Scanning distance: | 1 mm |
| (iii) Scanning time: | 60 sec |
| (iv) Stylus radius: | 2.5 μm |

Measurement results of each Example of the present invention and Comparative Examples are shown in Table 1.

TABLE 1

Composition of Coating Film of Printing Underlying Substrate

| Section | Type of base material | Resin base of paint | Titanium oxide having average particle diameter of 0.28 μm (mass %) | Hydrophobic silica having average particle diameter of 5.5 μm (mass %) | Hydrophobic silica having average particle diameter of 12 μm (mass %) | Mica having average particle diameter of 10 μm (mass %) | Surface roughness Ra (μm) based on JIS B 0601 |
|---|---|---|---|---|---|---|---|
| Example 1-1 | Molten | Thermosetting | 52 | 2 | 0 | 0 | 0.42 |
| Example 1-2 | Zn-55% Al | polyester | 52 | 4 | 0 | 0 | 0.548 |
| Example 1-3 | alloy plated | | 50 | 5 | 0 | 13 | 1.233 |
| Example 1-4 | steel sheet | | 54 | 0 | 5 | 10 | 1.897 |
| Example 1-5 | | | 47 | 0 | 7 | 15 | 2.878 |
| Comparative Example 1-1 | | | 36 | 2 | 0 | 0 | 0.361 |
| Comparative Example 1-2 | | | 42 | 0 | 8 | 18 | 3.012 |
| Example 2-1 | | Acrylic | 52 | 2 | 0 | 0 | 0.402 |
| Example 2-2 | | emulsion | 52 | 4 | 0 | 0 | 0.521 |
| Example 2-3 | | | 50 | 5 | 0 | 13 | 1.112 |
| Example 2-4 | | | 54 | 0 | 5 | 10 | 1.789 |

TABLE 1-continued

| Composition of Coating Film of Printing Underlying Substrate | | | | | | | |
|---|---|---|---|---|---|---|---|
| Section | Type of base material | Resin base of paint | Titanium oxide having average particle diameter of 0.28 μm (mass %) | Hydrophobic silica having average particle diameter of 5.5 μm (mass %) | Hydrophobic silica having average particle diameter of 12 μm (mass %) | Mica having average particle diameter of 10 μm (mass %) | Surface roughness Ra (μm) based on JIS B 0601 |
| Example 2-5 | | | 47 | 0 | 7 | 15 | 2.698 |
| Comparative Example 2-1 | | | 36 | 2 | 0 | 0 | 0.311 |
| Comparative Example 2-2 | | | 42 | 0 | 8 | 18 | 3.095 |
| Example 3-1 | Wood fiber | Acrylic | 52 | 2 | 0 | 0 | 0.475 |
| Example 3-2 | reinforced | emulsion | 52 | 4 | 0 | 0 | 0.574 |
| Example 3-3 | cement | | 50 | 5 | 0 | 13 | 1.263 |
| Example 3-4 | plate-based | | 54 | 0 | 5 | 10 | 1.972 |
| Example 3-5 | ceramic | | 47 | 0 | 7 | 15 | 2.894 |
| Comparative Example 3-1 | siding | | 36 | 2 | 0 | 0 | 0.39 |
| Comparative Example 3-2 | | | 42 | 0 | 8 | 18 | 3.285 |

3. Formation of Image with Active Ray-Curable Ink

The volume of an ink liquid drop was set to 42 pl and 14 pl, and inkjet printing of the above-mentioned Examples of the present invention was performed with an ink jet printing machine (manufactured by Trytec Corporation, Patterning jet). The printing conditions in this case are as follows.

Ink Jet Printing Conditions 1

| | |
|---|---|
| (a) Nozzle diameter: | 35 μm |
| (b) Applied voltage: | 11.5 V |
| (c) Pulse width: | 10.0 μs |
| (d) Driving frequency: | 3,483 Hz |
| (e) Resolution: | 360 dpi |
| (f) Volume of ink drop: | 42 pl |
| (g) Head heating temperature: | 45° C. |
| (h) Ink application amount: | 8.4 g/m$^2$ |
| (i) Distance between head and recording surface: | 5.0 mm |
| (j) Initial speed of ink drop: | 5.9 m/sec |

Ink Jet Printing Conditions 2

| | |
|---|---|
| (a) Nozzle diameter: | 35 μm |
| (b) Applied voltage: | 11.5 V |
| (c) Pulse width: | 5.2 μs |
| (d) Driving frequency: | 7,846 Hz |
| (e) Resolution: | 720 dpi |
| (f) Volume of ink drop: | 14 pl |
| (g) Head heating temperature: | 45° C. |
| (h) Ink application amount: | 11.2 g/m$^2$ |
| (i) Distance between head and recording surface: | 2.5 mm |
| (j) Initial speed of ink drop: | 6.0 m/sec |

Ink Jet Printing Conditions 3

| | |
|---|---|
| (a) Nozzle diameter: | 35 μm |
| (b) Applied voltage: | 13.2 V |
| (c) Pulse width: | 10.0 μs |
| (d) Driving frequency: | 3,483 Hz |
| (e) Resolution: | 360 dpi |
| (f) Volume of ink drop: | 42 pl |
| (g) Head heating temperature: | 45° C. |

-continued

| | |
|---|---|
| (h) Ink application amount: | 8.4 g/m$^2$ |
| (i) Distance between head and recording surface: | 5.0 mm |
| (j) Initial speed of ink drop: | 8.1 m/sec |

Ink Jet Printing Conditions 4

| | |
|---|---|
| (a) Nozzle diameter: | 35 μm |
| (b) Applied voltage: | 9.9 V |
| (c) Pulse width: | 10.0 μs |
| (d) Driving frequency: | 3,483 Hz |
| (e) Resolution: | 360 dpi |
| (f) Volume of ink drop: | 42 pl |
| (g) Head heating temperature: | 45° C. |
| (h) Ink application amount: | 8.4 g/m$^2$ |
| (i) Distance between head and recording surface: | 5.0 mm |
| (j) Initial speed of ink drop: | 3.9 m/sec |

A UV ray was used as an active ray in the Examples. The ink was subjected to UV-ray curing after the ink jet printing under the following conditions.

(1) Kind of lamp: high-pressure mercury lamp (manufactured by Fusion UV Systems Japan K.K., H bulb)

(2) Power of lamp: 200 W/cm (3) Integrated light amount: 600 mJ/cm$^2$ (measured by using UV meter UV-351-25 manufactured by ORC Manufacturing Co., ltd.)

In the Examples, as the active ray-curable ink, radically polymerizable UV ray-curable ink and cationically polymerizable UV ray-curable ink were used. The specific composition of each ink is as follows.

Radically Polymerizable UV Ray-Curable Ink Magenta Ink

| | |
|---|---|
| Pigment dispersion liquid[1)] (pigment content: 20 mass %) | 20 parts by mass |
| Reactive oligomer[2)] | 25 parts by mass |
| Reactive oligomer[3)] | 47 parts by mass |

-continued

| | |
|---|---|
| Photopolymerization initiator[4)] | 5 parts by mass |
| Photopolymerization initiator[5)] | 3 parts by mass |

[1)]Pigment: 160ED, iron oxide, manufactured by Toda Kogyo Corp., dispersion medium: SR9003, PO-modified neopentyl glycol diacrylate, manufactured by Sartomer Japan Inc.
[2)]CN985B88, mixture of 88 mass % of bifunctional aliphatic urethane acrylate and 12 mass % of 1,6-hexanediol diacrylate, manufactured by Sartomer Japan Inc.
[3)]1,6-Hexanediol diacrylate
[4)]IRGACURE 184, hydroxy ketone, manufactured by Ciba Japan
[5)]IRGACURE 819, acylphosphine oxide, manufactured by Ciba Japan Yellow Ink Yellow ink was used in the same composition as that of the magenta ink except that the pigment dispersion liquid (pigment content: 20 mass %) was changed, and 20 parts by mass of the changed pigment dispersion liquid was used.

The composition of the pigment dispersion liquid is as follows. Pigment: TSY-1, yellow iron oxide, manufactured by Toda Kogyo Corp., dispersion medium: SR9003, PO-modified neopentyl glycol diacrylate, manufactured by Sartomer Japan Inc.

Cyan Ink

Cyan ink was used in the same composition as that of the magenta ink except that the composition of the pigment dispersion liquid (pigment content: 40 mass %) was changed as follows, the addition amount thereof was set to 25 parts by mass, and the addition amount of the reactive oligomer[3)] was set to 42 parts by mass.

The composition of the pigment dispersion liquid is as follows. Pigment: DAIPYROXIDE BLUE 9410, cobalt blue, manufactured by Dainichiseika Color & Chemicals Mfg. Co., Ltd., dispersion medium: SR9003, PO-modified neopentyl glycol diacrylate, manufactured by Sartomer Japan Inc.)

Black Ink

Black ink was used in the same composition as that of the magenta ink except that the composition of the pigment dispersion liquid (pigment content: 20 mass %) was changed as follows, the addition amount thereof was set to 10 parts by mass, and the addition amount of the reactive oligomer[3)] was set to 57 parts by mass. Ink having the same composition as that of the magenta ink except that the pigment dispersion liquid was changed as follows and the addition amount of the reactive oligomer was set to 57 parts by weight was used.

The composition of the pigment dispersion liquid is as follows. Pigment: NIPex 35, carbon, manufactured by Degussa Japan Co., Ltd., dispersion medium: SR9003, PO-modified neopentyl glycol diacrylate, manufactured by Sartomer Japan Inc.

Cationically Polymerizable UV Ray-curable Ink 20 Parts by mass of each of four kinds of pigments described below were added to 9 parts by mass of a polymer dispersant (manufactured by Ajinomoto Fine-Techno Co., Inc., PB821) and 71 parts by mass of an oxetane compound (manufactured by Toagosei Co., Ltd., OXT211), and the mixture was sealed in a glass bottle together with 200 g of zirconia beads each having a diameter of 1 mm. The mixture was dispersed by a paint shaker for 4 hours. After that, the zirconia beads were removed to prepare pigment dispersions of four colors.

Black: Pigment Black 7

Blue: Cyanine Blue 4044 (manufactured by Sanyo Color Works, Ltd.)

Yellow: Pigment Yellow 138

Magenta: Pigment Red 122

The following photopolymerizable compounds, basic compound, surfactants, compatibilizer, and photoacid generator were mixed with 14 parts by mass of each of the above-mentioned dispersions, to thereby produce cationically polymerizable UV ray-curable ink-jet ink.

TABLE 2

| Component | Blending amount |
|---|---|
| Photopolymerizable compound | |
| Epoxidized linseed oil Vikoflex 9040 (manufactured by Atofina) | 4 parts by mass |
| EP-1, see JP 4539104 B2 for its structural formula | 34 parts by mass |
| Oxetane compound OXT-221 (manufactured by Toagosei Co., Ltd.) | 24 parts by mass |
| Oxetane compound OXT-211 (manufactured by Toagosei Co., Ltd.) | 8.9 parts by mass |
| Basic composition | |
| N-Ethyldiethanolamine | 0.05 part by mass |
| Surfactant | |
| MEGAFACE F178k (perfluoroalkyl group-containing acrylic oligomer (manufactured by Dainippon Ink and Chemicals)) | 0.025 part by mass |
| MEGAFACE F1405 (perfluoroalkyl group-containing ethylene oxide adduct (manufactured by DIC Corporation) | 0.025 part by mass |
| Compatibilizer | |
| HISOLVE BDB (manufactured by Toho Chemical Industry Co., Ltd., glycol ether) | 10 parts by mass |
| Photoacid generator | |
| UV16992 (manufactured by The DOW Chemical Company) | 5 parts by mass |

Experiment 1

Printing was performed on a recording surface of a recording material through use of cationically polymerizable UV ray-curable ink (magenta) under the above-mentioned ink jet printing conditions 1. The dot diameter (μm) of an ink drop was measured after 0.5 second, 0.8 second, 1.0 second, 1.6 seconds, 2.0 seconds, 2.2 seconds, 2.7 seconds, 3.5 seconds, 4.6 seconds, 6.8 seconds, 10.5 seconds, and 30.0 seconds from landing of the ink drop on the recording surface.

The dot diameter was measured through use of a scanning confocal laser microscope LEXTOLS3000 manufactured by Olympus Corporation. In the case where the spread of a dot was close to an oval, the average value of the long diameter and short diameter was defined as a dot diameter.

Figure 3:
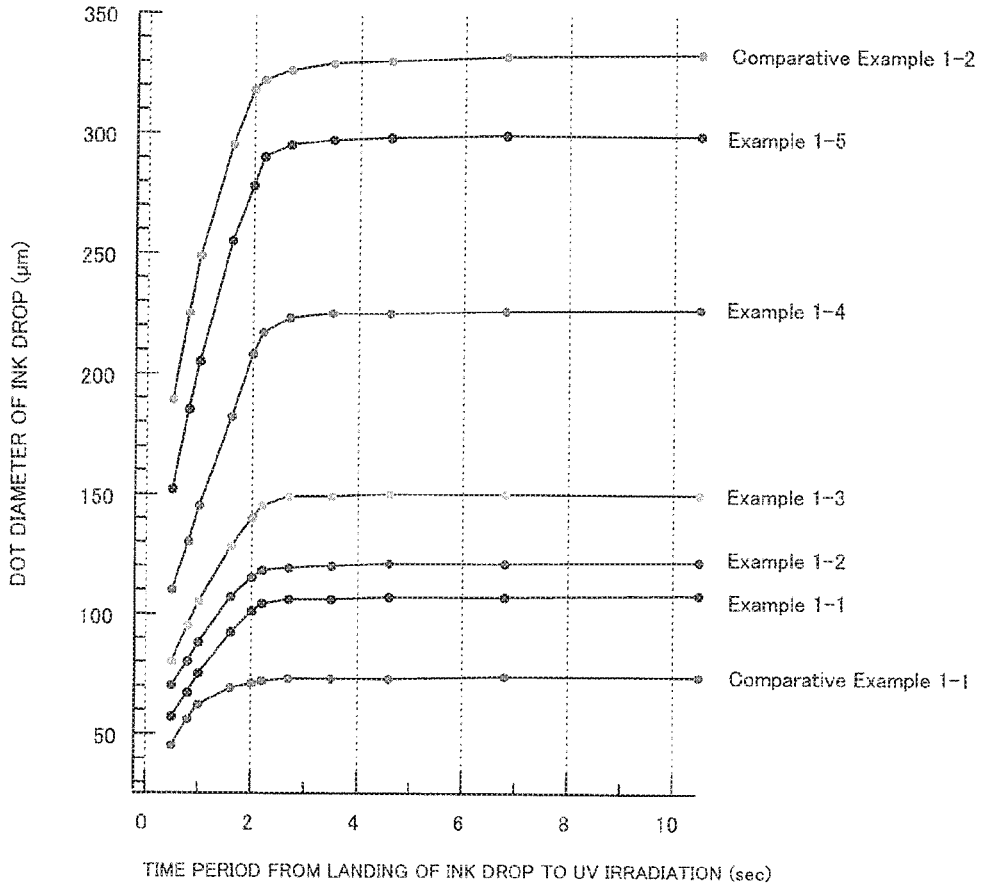
FIG. 3 is a graph for showing results of Experiment 1.

The results are shown in FIG. 3.

From FIG. 3, it is found that, in Examples of the present invention 1-1 to 1-5 and Comparative Example 1-2, the dot diameter of the ink drop rapidly spreads within 1 second, and then the spread substantially remains on a plateau. In contrast, it is found that, in Comparative Example 1-1 (Ra value: 0.361 μm), the spread of a dot diameter becomes slow after 1.5 seconds, and the spread substantially remains on a plateau and the dot diameter does not spread after 2.2 seconds.

Thus, it is understood that, in order to maintain sufficient wet spread of ink, the Ra value needs to be 0.4 μm or more.

It should be noted that similar results were obtained also in the case where printing was performed under Ink Jet Printing Conditions 2, and similar results were obtained also in Examples 2-1 to 2-5 and 3-1 to 3-5 (not shown).

Experiment 2

A recording surface was printed 100% in black through use of black ink under the above-mentioned ink jet printing conditions. The ink was irradiated with a UV ray after 2.2 seconds from landing of the ink on the recording surface, and an L* value at this time was measured. For measurement of the L* value, a spectrocolorimeter SpectroEye manufactured by X-Rite was used.

As the L* value is lower, the wet spread of ink becomes larger, and ink spreads with wetting without any gap. Further, in the case where the wet spread of ink is insufficient, a coating film surface of an underlying application base material is partially exposed, and hence the L* value becomes high. A or higher is a usable level.

○: The L* value is less than 30.

Δ: The L* value is 30 or more and less than 40.

x: The L* value is 40 or more.

Results obtained by performing printing under Ink Jet Printing Conditions 1, 3 and 4 are shown in Table 3, and results obtained by performing printing under Ink Jet Printing Conditions 2 are shown in Table 4.

TABLE 3

| | Ink jet printing conditions 1 | | Ink jet printing conditions 3 | | Ink jet printing conditions 4 | |
|---|---|---|---|---|---|---|
| | Radically polymerizable | Cationically polymerizable | Radically polymerizable | Cationically polymerizable | Radically polymerizable | Cationically polymerizable |
| Example 1-1 | Δ | Δ | Δ | Δ | Δ | Δ |
| Example 1-2 | ○ | ○ | ○ | ○ | ○ | ○ |
| Example 1-3 | ○ | ○ | ○ | ○ | ○ | ○ |
| Example 1-4 | ○ | ○ | ○ | ○ | ○ | ○ |
| Example 1-5 | Δ | Δ | Δ | Δ | Δ | Δ |
| Comparative Example 1-1 | x | x | x | x | x | x |
| Comparative Example 1-2 | x | x | x | x | x | x |
| Example 2-1 | Δ | Δ | Δ | Δ | Δ | Δ |
| Example 2-2 | ○ | ○ | ○ | ○ | ○ | ○ |
| Example 2-3 | ○ | ○ | ○ | ○ | ○ | ○ |
| Example 2-4 | ○ | ○ | ○ | ○ | ○ | ○ |
| Example 2-5 | Δ | Δ | Δ | Δ | Δ | Δ |
| Comparative Example 2-1 | x | x | x | x | x | x |
| Comparative Example 2-2 | x | x | x | x | x | x |
| Example 3-1 | Δ | Δ | Δ | Δ | Δ | Δ |
| Example 3-2 | ○ | ○ | ○ | ○ | ○ | ○ |
| Example 3-3 | ○ | ○ | ○ | ○ | ○ | ○ |
| Example 3-4 | ○ | ○ | ○ | ○ | ○ | ○ |
| Example 3-5 | Δ | Δ | Δ | Δ | Δ | Δ |
| Comparative Example 3-1 | x | x | x | x | x | x |
| Comparative Example 3-2 | x | x | x | x | x | x |

TABLE 4

| | Radically polymerizable | Cationically polymerizable |
|---|---|---|
| Example 1-2 | ○ | ○ |
| Example 1-3 | ○ | ○ |
| Comparative Example 1-1 | x | x |
| Comparative Example 1-2 | x | x |
| Example 2-2 | ○ | ○ |
| Example 2-3 | ○ | ○ |
| Comparative Example 2-1 | x | x |
| Comparative Example 2-2 | x | x |
| Example 3-2 | ○ | ○ |
| Example 3-3 | ○ | ○ |

TABLE 4-continued

| | Radically polymerizable | Cationically polymerizable |
|---|---|---|
| Comparative Example 3-1 | x | x |
| Comparative Example 3-2 | x | x |

From the results in the above tables, it is understood that similar results are obtained irrespective of whether radically polymerizable ink or cationically polymerizable ink is used. Further, it was confirmed that sufficient ink wet spread property was ensured at an arithmetic average roughness (Ra) within a range of from 0.4 μm to 3.0 μm.

Experiment 3

In order to confirm the physical strength of ink after curing, scratch hardness (pencil method) measurement was performed based on JIS K5600 5-4.

The whole surface of an ink receiving layer was printed using cyan ink, magenta ink, yellow ink, and black ink under the above-mentioned ink jet printing conditions. The ink was irradiated with a UV ray after 2.2 seconds, 30 seconds, and 35 seconds from the ink landing on the recording surface, and pencil strength was evaluated by the above-mentioned measurement method. In the case where the value of pencil hardness varied depending on the color, a low pencil hardness value was defined as a representative value. Δ or higher is a usable level. Results obtained by performing printing under the Jet Printing Conditions 1 are shown in Table 5, and results obtained by performing printing under Ink Jet Printing Conditions 2 are shown in Table 6.

○○: 2H or more

○: H

Δ: HB to F x: B or less

TABLE 5

| | Pencil Hardness of Ink Coating Film | | | | | |
|---|---|---|---|---|---|---|
| | Irradiation of UV ray after 2.2 seconds from landing of ink | | Irradiation of UV ray after 30 seconds from landing of ink | | Irradiation of UV ray after 35 seconds from landing of ink | |
| | Radically polymerizable | Cationically polymerizable | Radically polymerizable | Cationically polymerizable | Radically polymerizable | Cationically polymerizable |
| Example 1-1 | ○ | ○○ | ○ | Δ | x | x |
| Example 1-2 | ○ | ○○ | ○ | Δ | x | x |
| Example 1-3 | ○ | ○○ | ○ | Δ | x | x |
| Example 1-4 | ○ | ○○ | ○ | Δ | x | x |
| Example 1-5 | ○ | ○○ | ○ | Δ | x | x |
| Comparative Example 1-1 | ○ | ○○ | ○ | Δ | x | x |
| Comparative Example 1-2 | ○ | ○○ | ○ | Δ | x | x |
| Example 2-1 | ○ | ○○ | Δ | Δ | x | x |
| Example 2-2 | ○ | ○○ | Δ | Δ | x | x |
| Example 2-3 | ○ | ○○ | Δ | Δ | x | x |
| Example 2-4 | ○ | ○○ | Δ | Δ | x | x |
| Example 2-5 | ○ | ○○ | Δ | Δ | x | x |
| Comparative Example 2-1 | ○ | ○○ | Δ | Δ | x | x |
| Comparative Example 2-2 | ○ | ○○ | Δ | Δ | x | x |
| Example 3-1 | ○ | ○○ | ○ | Δ | x | x |
| Example 3-2 | ○ | ○○ | ○ | Δ | x | x |
| Example 3-3 | ○ | ○○ | ○ | Δ | x | x |
| Example 3-4 | ○ | ○○ | ○ | Δ | x | x |
| Example 3-5 | ○ | ○○ | ○ | Δ | x | x |
| Comparative Example 3-1 | ○ | ○○ | ○ | Δ | x | x |
| Comparative Example 3-2 | ○ | ○○ | ○ | Δ | x | x |

TABLE 6

| | Pencil Hardness of Ink Coating Film | | | | | |
|---|---|---|---|---|---|---|
| | Irradiation of UV ray after 2.2 seconds from landing of ink | | Irradiation of UV ray after 30 seconds from landing of ink | | Irradiation of UV ray after 35 seconds from landing of ink | |
| | Radically polymerizable | Cationically polymerizable | Radically polymerizable | Cationically polymerizable | Radically polymerizable | Cationically polymerizable |
| Example 1-2 | ○ | ○○ | ○ | Δ | x | x |
| Example 1-3 | ○ | ○○ | ○ | Δ | x | x |
| Comparative Example 1-1 | ○ | ○○ | ○ | Δ | x | x |
| Comparative Example 1-2 | ○ | ○○ | ○ | Δ | x | x |
| Example 2-2 | ○ | ○○ | Δ | Δ | x | x |
| Example 2-3 | ○ | ○○ | Δ | Δ | x | x |
| Comparative Example 2-1 | ○ | ○○ | Δ | Δ | x | x |
| Comparative Example 2-2 | ○ | ○○ | Δ | Δ | x | x |
| Example 3-2 | ○ | ○○ | ○ | Δ | x | x |
| Example 3-3 | ○ | ○○ | ○ | Δ | x | x |
| Comparative Example 3-1 | ○ | ○○ | ○ | Δ | x | x |
| Comparative Example 3-2 | ○ | ○○ | ○ | Δ | x | x |

From the above-mentioned results, the ink irradiated with a UV ray after 2.2 seconds from the ink landing on the ink receiving layer had satisfactory physical strength after curing irrespective of whether the ink was a radically polymerizable ink or cationically polymerizable ink. Further, the cationically polymerizable ink had no oxygen polymerization inhibition and a low curing shrinkage ratio, and hence the cationically polymerizable ink had a pencil hardness higher than that of the radically polymerizable ink. The results of the ink irradiated with a UV ray after 30 seconds were not satisfactory as compared to those of the ink irradiated with a UV ray after 2.2 seconds, but the ink irradiated with a UV ray after 30 seconds can ensure physical strength to such a degree that there is no problem for use. However, sufficient physical strength was not recognized in any of the inks irradiated with a UV ray after 35 seconds from the ink landing on the surface of the ink receiving layer.

Experiment 4

Evaluation of Design Property

Each color of cyan, magenta, yellow, and black, was printed on 3 cm×3 cm areas in increments of 10% to a printing density of 100% under the above-mentioned ink jet printing conditions 1 and 2, and the ink was irradiated with a UV ray after 0.8 second and 2.2 seconds from the ink landing on the ink receiving layer. Design property was evaluated based on the gradation. Specifically, the state of dot wet spread in a 100% printed was confirmed. Further, a printed portion of from 20% to 60% was visually observed at a distance of 2 m, and thus particle-like feeling caused by dots was evaluated.

The results of the evaluation are described based on dot wet spread/particle-like feeling caused by dots. A or higher is a usable level. The dot wet spread property and particle-like feeling were evaluated by an average value of cyan, magenta, yellow, and black.

Dot Wet Spread Property in 100% Printed Portion

○: Area coated with ink is 100%.

Δ: Area coated with ink is 95% or more and less than 100%.

x: Area coated with ink is less than 95%.

Evaluation of Particle-like Feeling Caused by Dots

○○: No granular feeling.

○: Some granular feeling, but not conspicuous.

x: Granular feeling conspicuous.

Results obtained by performing printing under Ink Jet Printing Conditions 1 are shown in Table 7, and results obtained by performing printing under Ink Jet Printing Conditions 2 are shown in Table 8.

TABLE 7

| | Design Property Evaluation | | | |
|---|---|---|---|---|
| | Irradiation of UV ray after 0.8 second from landing of ink | | Irradiation of UV ray after 2.2 seconds from landing of ink | |
| | Radically polymerizable | Cationically polymerizable | Radically polymerizable | Cationically polymerizable |
| Example of present invention 1-1 | x/○○ | x/○○ | ○/○ | ○/○ |
| Example of present invention 1-2 | x/○○ | x/○○ | ○/○ | ○/○ |
| Example of present invention 1-3 | Δ/○ | Δ/○ | ○/○ | ○/○ |
| Example of present invention 1-4 | ○/○ | ○/○ | ○/○ | ○/○ |
| Example of present invention 1-5 | ○/○ | ○/○ | ○/○ | ○/○ |
| Comparative Example 1-1 | x/○ | x/○ | x/○ | x/○ |
| Comparative Example 1-2 | ○/○ | ○/○ | ○/x | ○/x |
| Example of present invention 2-1 | x/○○ | x/○○ | ○/○ | ○/○ |
| Example of present invention 2-2 | x/○○ | x/○○ | ○/○ | ○/○ |
| Example of present invention 2-3 | Δ/○ | Δ/○ | ○/○ | ○/○ |
| Example of present invention 2-4 | ○/○ | ○/○ | ○/○ | ○/○ |
| Example of present invention 2-5 | ○/○ | ○/○ | ○/○ | ○/○ |
| Comparative Example 2-1 | x/○ | x/○ | x/○ | x/○ |
| Comparative Example 2-2 | ○/○ | ○/○ | ○/x | ○/x |
| Example of present invention 3-1 | x/○○ | x/○○ | ○/○ | ○/○ |
| Example of present invention 3-2 | x/○○ | x/○○ | ○/○ | ○/○ |
| Example of present invention 3-3 | Δ/○ | Δ/○ | ○/○ | ○/○ |
| Example of present invention 3-4 | ○/○ | ○/○ | ○/○ | ○/○ |
| Example of present invention 3-5 | ○/○ | ○/○ | ○/○ | ○/○ |
| Comparative Example 3-1 | x/○ | x/○ | x/○ | x/○ |
| Comparative Example 3-2 | ○/○ | ○/○ | ○/x | ○/x |

TABLE 8

| | Design Property Evaluation | | | |
|---|---|---|---|---|
| | Irradiation of UV ray after 0.8 second from landing of ink | | Irradiation of UV ray after 2.2 seconds from landing of ink | |
| | Radically polymerizable | Cationically polymerizable | Radically polymerizable | Cationically polymerizable |
| Example of present invention 1-2 | x/○○ | x/○○ | ○/○○ | ○/○○ |
| Example of present invention 1-3 | ○/○○ | ○/○○ | ○/○○ | ○/○○ |
| Comparative Example 1-1 | x/○○ | x/○○ | x/○○ | x/○○ |
| Comparative Example 1-2 | ○/○ | ○/○ | ○/○ | ○/○ |
| Example of present invention 2-2 | x/○○ | x/○○ | ○/○○ | ○/○○ |
| Example of present invention 2-3 | ○/○○ | ○/○○ | ○/○○ | ○/○○ |
| Comparative Example 2-1 | x/○○ | x/○○ | x/○○ | x/○○ |
| Comparative Example 2-2 | ○/○ | ○/○ | ○/○ | ○/○ |
| Example of present invention 3-2 | x/○○ | x/○○ | ○/○○ | ○/○○ |
| Example of present invention 3-3 | ○/○○ | ○/○○ | ○/○○ | ○/○○ |
| Comparative Example 3-1 | x/○○ | x/○○ | x/○○ | x/○○ |
| Comparative Example 3-2 | ○/○ | ○/○ | ○/○ | ○/○ |

It should be noted that all contents of the specification, scope of claims, drawings, and abstract of Japanese Patent Application No. 2013-247592 filed on Nov. 29, 2013 are incorporated herein by reference as the disclosure of the description of the present invention.

REFERENCE SIGNS LIST

1: base material
2: primer layer
3: ink receiving layer
4: ink layer
5: solid particle
6: coloring pigment
M: line-type ink jet recording apparatus
10: conveyance part
11: conveyance surface
20: carriage
30: recording part
31: recording head unit (black)
32: recording head unit (cyan)
33: recording head unit (magenta)
34: recording head unit (yellow)
35: ink discharge surface
40: active ray irradiation part
50: control part
60: ink supply pipe
70: building board
71: ink receiving surface

The invention claimed is:

1. A method of manufacturing a decorative building board, comprising:

ejecting active ray-curable ink from an ink jet recording head onto a building board that includes a base material selected from a metallic base material and a ceramic base material and an ink receiving layer arranged on the base material, the ink receiving layer being obtained by curing a resin composition and having an arithmetic average roughness (Ra) specified under JIS B 0601: 2001 of from 0.4 μm to 3 μm, to thereby perform printing on the ink receiving layer; and irradiating the active ray-curable ink with an active ray from 2.2 seconds to 30 seconds after the active ray-curable ink lands on the ink receiving layer.

2. A method of manufacturing a decorative building board according to claim 1, wherein the ink receiving layer is non-permeable with respect to the active ray-curable ink.

3. A method of manufacturing a decorative building board according to claim 1, wherein the active ray-curable ink comprises active ray-curable cationically polymerizable ink.

4. A method of manufacturing a decorative building board according to claim 1, wherein a volume of one drop of the ink that lands on a surface of the ink receiving layer is 10 picoliters to less than 45 picoliters.

5. A method of manufacturing a decorative building board according to claim 1, wherein an initial speed of an ejected ink drop of the active ray-curable ink is from 3 m/sec to 9 m/sec.

6. A method of manufacturing a decorative building board according to claim 1, wherein the resin composition contains solid particles.

7. A method of manufacturing a decorative building board according to claim 6, wherein the solid particles comprise inorganic particles.

8. A method of manufacturing a decorative building board according to claim 7, wherein the inorganic particles comprise one or more kinds selected from the group consisting of silica, barium sulfate, talc, calcium carbonate, mica, glass beads, and glass flakes.

9. A method of manufacturing a decorative building board according to claim 6, wherein the solid particles have an average particle diameter of from 4 μm to 80 μm.

* * * * *